US006841528B2

(12) United States Patent
Kaiser et al.

(10) Patent No.: US 6,841,528 B2
(45) Date of Patent: Jan. 11, 2005

(54) METHOD FOR THE PRODUCTION OF LIQUID CLEANING AGENT OR DETERGENT COMPOSITIONS CONTAINING AT LEAST TWO SEPARATE AQUEOUS PHASES

(75) Inventors: Roger Kaiser, Limburgerhof (DE); Edgar Endlein, Wrestedt (DE); Mike Kosub, Bruchsal (DE); Karl-Ludwig Gibis, Ludwigshafen (DE); Alexandra Hary, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 10/022,953

(22) Filed: Dec. 14, 2001

(65) Prior Publication Data

US 2002/0077268 A1 Jun. 20, 2002

Related U.S. Application Data

(63) Continuation of application No. PCT/EP00/05475, filed on Jun. 14, 2000.

(30) Foreign Application Priority Data

Jun. 14, 1999 (DE) ..... 199 26 925

(51) Int. Cl.[7] ..... C11D 10/02
(52) U.S. Cl. ..... 510/417; 510/405; 510/108
(58) Field of Search ..... 510/417, 405, 510/108

(56) References Cited

U.S. PATENT DOCUMENTS

| | | | | | |
|---|---|---|---|---|---|
| 3,533,955 | A | | 10/1970 | Pader et al. | 510/121 |
| 4,107,067 | A | | 8/1978 | Murphy et al. | 510/336 |
| 4,348,292 | A | * | 9/1982 | Ginn | 252/90 |
| 4,749,516 | A | * | 6/1988 | Brusky | 510/284 |

FOREIGN PATENT DOCUMENTS

| | | | | |
|---|---|---|---|---|
| EP | 0 116 422 | A1 | | 8/1984 |
| EP | 116422 | | * | 8/1984 |
| EP | 0175485 | A2 | * | 3/1986 |
| EP | 0 256 343 | A1 | | 2/1988 |
| GB | 1247189 | A | * | 9/1971 |
| GB | 1247189 | | * | 9/1971 |
| GB | 2 309 226 | A | | 7/1997 |
| JP | 60-243199 | A | | 12/1985 |
| WO | WO 99/47634 | A1 | | 9/1999 |
| WO | WO 99/47635 | A2 | | 9/1999 |
| WO | Wo 01/30958 | A1 | * | 3/2001 |

* cited by examiner

*Primary Examiner*—Charles Boyer
(74) *Attorney, Agent, or Firm*—Akin Gump Strauss Hauer & Feld, L.L.P.

(57) ABSTRACT

A method is provided for the production of liquid cleaning agent or detergent compositions which are ready to use and packaged. In rest (quiescent) condition the compositions exist separately in at least two aqueous phases. At least two separate preliminary mixtures are produced, exhibiting non phase separation in a temperature range of about 0° C.–40° C. The preliminary mixtures are mixed together only upon or directly before they are placed in the packaging container.

10 Claims, No Drawings

METHOD FOR THE PRODUCTION OF LIQUID CLEANING AGENT OR DETERGENT COMPOSITIONS CONTAINING AT LEAST TWO SEPARATE AQUEOUS PHASES

CROSS-REFERENCE TO RELATED APPLICATIONS

This application is a continuation of International Application No. PCT/EP00/05475, filed Jun. 14, 2000, the disclosure of which is incorporated herein by reference.

BACKGROUND OF THE INVENTION

The present invention relates to a method of manufacturing liquid cleaning or detergent compositions, which separate into at least two aqueous phases in the rest condition.

One problem which often occurs, both when cleaning hard surfaces, in particular in the kitchen or bathroom area, and when washing soiled fabrics, is that inorganic as well as organic dirt has to be removed. Whereas surface-active agents are usually used to remove organic dirt, they are normally less effective, and in many cases even totally ineffective, when it comes to removing inorganic dirt. In order to remove inorganic dirt, it is therefore necessary to use compounds, generally in aqueous solution, which are suitable for dissolving or detaching this dirt. Depending on the nature of the dirt, these might be acid, neutral or alkaline compounds.

In order to detach deposits of lime scale, which are usually attributable to hardness-forming elements in water, it is preferable to use acid aqueous solutions. In order to remove other types of organic dirt, for example dirt containing clay and/or pigment, it is preferable to use aqueous solutions of ingredients which produce a pH value in the neutral or alkaline range in aqueous solution. In both cases, however, it has been found that the addition of surface-active agents to aqueous solutions used for removing inorganic dirt (if they are also required to remove organic dirt) can lead to a significant reduction in their effectiveness against inorganic dirt.

In German patent application 198 49 247.2, filed by the present applicant, a liquid cleaning or detergent composition which separates into at least two aqueous phases in the rest condition is proposed as a means of resolving this problem. A composition of this type leads to an unexpected improvement in the cleaning effect and, in particular, exhibits a dual action against both organic and inorganic dirt. If such a composition is shaken or mixed before or during use, a dispersion is produced which enables homogeneous application on the surface or substrate. Both on the surface or substrate and in the supply container, this dispersion separates again relatively quickly if left to stand, forming two separate aqueous phases.

The fact that these products consist of at least two liquid phases in equilibrium in the rest condition causes particular difficulties during the manufacturing process. If the products are produced in batches in a liquid mixer, all processes following mixing (such as transportation, storage, packaging, etc.) must be carried out with the mixed product which—by definition—has a tendency to assume the state of equilibrium in which the aqueous phases separate in each rest phase. This being the case, it is difficult to ensure that the relative quantity of each of the several, preferably two, phases remains constant over time.

To do this, it would be necessary, throughout the entire production process, i.e. even during transportation, storage, packaging, etc., to provide for continuous mixing to ensure homogeneity of the product, which will only be effective if the separate aqueous phases of the packaged end product are in the correct predetermined ratio by volume, as desired.

This solution would bring with it specific complications and restrictions in terms of the equipment needed. Conventional filling devices, e.g., metering by means of volumetric cylinders, would be unsuitable. However, even if all equipment components could be set up to meet the requirement of providing continuous mixing, the residence times in the plant would prove to be particularly problematic, since any volumes of product remaining in the system (conduits, filling system, etc.) during these residence periods would undergo the same phase separation desired in the end product.

Even the alternative of separately formulating and packaging the several, preferably two, phases, so that the multi-phase product is not obtained until this stage, provides no satisfactory solution to the problem described above, because each of the two phases is at the equilibrium point, and therefore any slight change, for example in temperature, pressure, etc., could influence the equilibrium, such that multi-phase intermediate products would arise, in which the same processing difficulties would present themselves as those outlined above.

BRIEF SUMMARY OF THE INVENTION

Accordingly, an object of the invention is to provide a method of manufacturing the generic compositions, which overcomes said problems. This object is achieved according to the invention in that at least two separate preliminary or intermediate mixtures are produced, which do not exhibit phase separation within the temperature range of about 0° C. to 40° C., and these preliminary mixtures are not mixed with one another until immediately prior to or upon filling into the packaging container. Preferably, the composition of each preliminary mixture herein is different from the composition of each of the separate aqueous phases arising in the end product in the rest condition.

DETAILED DESCRIPTION OF THE INVENTION

In one particular embodiment of the invention, it is proposed that a first preliminary mixture should contain, in addition to water which is the main ingredient, the substance (s) used in the overall composition, but in the absence of which the overall composition essentially does not form separate aqueous phases, the remaining ingredients of the overall composition being contained in a second preliminary mixture, the main ingredient of which is also water.

In this embodiment, the first preliminary mixture may contain, if present in the overall composition, a hydrophobic substance, for example, or a substance which forms a hydrophobic substance in conjunction with one or more other substances of the overall composition, and which, if present in the overall composition, may be in particular one or more perfumes, one or more hydrophobic, water-insoluble solvents and/or, if one or more quaternary ammonium salts and one or more sulfates are present in the overall composition, one of these two groups of substances.

In other compositions the first preliminary mixture may particularly contain, if present in the overall mixture, one or more water-soluble substances with a low cloud point and, wherein these might be one or more quaternary ammonium salts and/or one or more surface-active agents with an ethylene oxide and/or propylene oxide base, for example.

Preferably, the first preliminary mixture and the second preliminary mixture are present in a ratio of from 5/95 to 50/50 by volume prior to mixing.

Surprisingly, the present invention offers a simple and effective way of avoiding the problems outlined above. Here, the person skilled in the art will have no difficulty in identifying those compounds in the overall composition which, on the one hand, produce a stable composition when taken together with water and, on the other hand, also enable the remaining ingredients of the overall composition to be combined with water to produce a stable composition. The term "stable" in this context is intended to mean that the aqueous compositions do not exhibit any substantial phase separation within a temperature range of about 0° C. to 40° C., i.e., they produce solutions or homogeneous dispersions.

The division of the ingredients of the composition between the aqueous preliminary mixtures will naturally depend to a large degree on what ingredients are incorporated in the overall composition itself. Since it is not always possible to establish clearly in every case which compounds or combinations of compounds are responsible for causing the desired phase separation of the overall composition, it will be necessary to determine the composition of the preliminary mixture in each individual case through appropriate tests, and these can be easily conducted by the person skilled in the art on the basis of the known effect of the individual compounds in the overall composition and their limited number, particularly without any personal inventive activity.

Based on the ingredients used in the case of an alkaline product, such as described in Example 1 below, the skilled person would specifically incorporate the hydrophobic materials or the water-soluble compounds which have a low cloud point in the first preliminary mixture. These might be, for example, the perfume(s) or hydrophobic, water-insoluble solvents/alcohols or the quaternary ammonium salt(s) or surfactants based on ethylene oxide and propylene oxide, which are known to have a low cloud point in spite of being soluble in water, in order to keep these separate from the rest of the formulation, in particular the builder system (chloride, carbonate, phosphate). In example 1, specifically the quaternary ammonium salt was kept separate, which was sufficient to produce two stable preliminary mixtures.

In an acid composition, such as described in Example 2, one specific solution is to avoid the formation of hydrophobic material, generated by combining sulphonate and quaternary ammonium salt in the overall composition, by keeping one of these two substances or groups of substances separate in the first preliminary mixture. In the specific example described, the sulphonate was chosen for this purpose. However, both of the quaternary ammonium salts could just as easily have been kept separate by placing them in the first preliminary mixture and the sulphonate left in the second preliminary mixture.

EXAMPLE 1

The table below gives the composition of both the first and the second preliminary mixtures and the different composition of the upper and lower phases of the end product for an alkaline detergent composition. During production, the first and the second preliminary mixtures were introduced in a ratio of 20:80 by volume. The two preliminary mixtures were mixed by filling the packaging container first with the first preliminary mixture (which has the lower volume in this particular case) followed by the second preliminary mixture (having the larger volume), whereby an appropriate overall mixture occurs.

| | First pre-mixture | Second pre-mixture | Upper phase of end product | Lower phase of end product |
|---|---|---|---|---|
| Didecyl dimethyl ammonium chloride | 10.00 | 0.00 | 4.00 | 0.00 |
| Alkyl alkoxylate | 0.00 | 0.625 | 1.00 | 0.00 |
| Glycerine-N-(3-aminopropyl)-$C_{10}$-$C_{16}$-alkyl derivative | 0.00 | 1.50 | 2.40 | 0.00 |
| Alkyl amidopropyl | 0.00 | 0.75 | 1.20 | 0.00 |
| $Na_2CO_3$ | 0.00 | 0.625 | 0.5 | 0.5 |
| $K_5P_3O_{10}$ | 0.00 | 1.28 | 1.02 | 1.02 |
| NaCl | 0.00 | 1.625 | 1.3 | 1.3 |
| Perfume | 0.00 | 0.25 | 0.40 | 0.00 |
| Colorant | 0.00 | 0.0019 | 0.0030 | 0.00 |
| Anti-foaming agent | 0.00 | 0.0063 | 0.005 | 0.005 |
| Water | 90.00 | 93.3419 | 88.172 | 97.175 |
| | 100.00 | 100.00 | 100.00 | 100.0 |

EXAMPLE 2

The table below gives the compositions of both the first and the second preliminary mixtures and the different compositions of the upper and lower phases of the end product for an acid detergent composition. During production, the first and the second preliminary mixtures were introduced in a ratio of 20:80 by volume. In this instance too, mixing of the two preliminary mixtures was effected first by filling the first preliminary mixture (which in this particular case has of the lower volume) followed by the second preliminary mixture (with the larger volume) into the packaging container.

| | First pre-mixture | Second pre-mixture | Upper phase of end product | Lower phase of end product |
|---|---|---|---|---|
| Phosphoric acid | 0.0000 | 4.6875 | 3.75 | 3.75 |
| Amidosulphonic acid | 0.00 | 6.25 | 5.00 | 5.00 |
| Sodium cumene sulphonate | 0.093 | 1.2206 | 1.99016 | 0.00 |
| Hexadecyl trimethyl ammonium chloride | 0.000 | 1.875 | 3.00 | 0.00 |
| Oleyl trimethyl ammonium chloride | 0.000 | 0.625 | 1.0 | 0.00 |
| Colorant | 0.000000 | 0.001875 | 0.0030 | 0.00 |
| Perfume | 0.0000 | 0.1875 | 0.30 | 0.00 |
| Water | 99.91 | 85.1531 | 84.95684 | 91.25 |
| | 100.00 | 100.00 | 100.00 | 100.00 |

The disclosed features of the invention in the above description and in the claims may essentially be used either individually or in any desired combination for realization of the invention in its various embodiments. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of manufacturing a ready-to-use, packaged liquid cleaning or detergent composition, which separates into at least two aqueous phases in the rest condition, comprising producing at least two separate aqueous preliminary mixtures, which do not exhibit any phase separation within a temperature range of about 0° C. and 40° C., and refraining from mixing these preliminary mixtures with one another until immediately prior to or upon filling the mixtures in a packaging container.

2. The method of claim 1, wherein the composition of each preliminary mixture is different from the composition of each of the aqueous phases which separate in the end product in the rest condition.

3. The method of claim 1, wherein a first preliminary mixture contains, in addition to water as the main ingredient, substance(s) used in the overall composition but in the absence of which the overall composition essentially would not form separate aqueous phases, and a second preliminary mixture, the main ingredient of which is also water, contains remaining substances of the overall composition.

4. The method of claim 3, wherein the first preliminary mixture contains a hydrophobic substance or a substance which forms a hydrophobic substance with one or more other substance of the overall composition, the other substance being selected from the group consisting of perfumes; hydrophobic, water-insoluble solvents; and, in a case where one or more quaternary ammonium salts and one or more sulfates are present, one of quaternary ammonium salts and sulfates.

5. The method of claim 4, wherein the first preliminary mixture contains perfume(s); hydrophobic, water-insoluble solvent(s); and one of quaternary ammonium salt(s) and sulphonate(s) if both of these groups are present in the overall composition.

6. The method of claim 3, wherein the first preliminary mixture contains one or more water-soluble substances with a low cloud point.

7. The method of claim 6, wherein the first preliminary mixture contains a substance selected from the group consisting of quaternary ammonium salts and surface-active agents with an ethylene oxide and/or propylene oxide base.

8. The method of claim 3, wherein the first preliminary mixture and the second preliminary mixture are present in a ratio of about 5/95 to 50/50 by volume prior to mixing.

9. The method of claim 1, further comprising filling the packing container with at least one preliminary mixture and subsequently or substantially simultaneously filling the container with a second preliminary mixture.

10. A method of manufacturing a ready-to-use, packaged, liquid cleaning or detergent composition, which separates into at least two aqueous phases in the rest condition, the method comprising the steps of:

producing at least two separate preliminary mixtures which do not exhibit any phase separation within a temperature range of about 0° C. to 40° C.;

refraining from mixing the at least two preliminary mixtures with one another until immediately prior to or upon filling the mixtures into a packaging container; and mixing and packaging the at least two separate preliminary mixtures to form the ready-to-use, packaged, liquid cleaning or detergent composition, wherein the at least two aqueous phases in the rest condition each have compositions which are different from the compositions of each of the at least two preliminary mixtures.

* * * * *